US010141679B2

(12) United States Patent
Ono et al.

(10) Patent No.: US 10,141,679 B2
(45) Date of Patent: Nov. 27, 2018

(54) ELECTRICAL CONNECTOR

(71) Applicant: SMK Corporation, Tokyo (JP)

(72) Inventors: Naoyuki Ono, Chiba (JP); Osamu Hayashi, Kanagawa (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 15/657,193

(22) Filed: Jul. 23, 2017

(65) Prior Publication Data

US 2018/0034194 A1 Feb. 1, 2018

(30) Foreign Application Priority Data

Jul. 26, 2016 (JP) ..... 2016-146146

(51) Int. Cl.

| | |
|---|---|
| ***H01R 13/40*** | (2006.01) |
| ***H01R 13/52*** | (2006.01) |
| ***H01R 13/28*** | (2006.01) |
| ***H01R 13/422*** | (2006.01) |
| ***H01R 13/6581*** | (2011.01) |
| ***H01R 31/08*** | (2006.01) |
| ***H01R 24/60*** | (2011.01) |

(52) U.S. Cl.

CPC ..... *H01R 13/5202* (2013.01); *H01R 13/28* (2013.01); *H01R 13/4223* (2013.01); *H01R 13/5219* (2013.01); *H01R 13/6581* (2013.01); *H01R 24/60* (2013.01); *H01R 31/08* (2013.01)

(58) Field of Classification Search

CPC ..... H01R 13/5208; H01R 13/443; H01R 13/5213; H01R 13/521; H01R 13/5216

USPC ..... 439/587, 148, 936, 588, 589, 275, 279, 439/489

See application file for complete search history.

(56) References Cited

U.S. PATENT DOCUMENTS

| | | | | |
|---|---|---|---|---|
| 2011/0230074 | A1 | 9/2011 | Schmidt et al. | |
| 2014/0308833 | A1 | 10/2014 | Fukami et al. | |
| 2015/0155661 | A1* | 6/2015 | Chen | H01R 13/6582 439/607.01 |

OTHER PUBLICATIONS

Office Action issued for counterpart Japanese Application 2016-146146, issued by the Japan Patent Office dated Oct. 4, 2016.

Office Action issued for counterpart Japanese Application 2016-146146, issued by the Japan Patent Office dated Jan. 24, 2017.

* cited by examiner

*Primary Examiner* — Phuong Chi T Nguyen

(57) ABSTRACT

A waterproof attachment portion to an enclosure is formed to implement the reduction in height, reduction in size, and positive waterproof effects at the same time. An electrical connector includes: an electrically conductive contact; an insulating housing for holding the contact; a metal shell which includes an opening opened frontward to allow a mating connector to be inserted therein and accommodates the housing; and a sealing member which is provided on the outer peripheral surface of the metal shell and protruded frontward from the metal shell.

6 Claims, 7 Drawing Sheets

ELECTRICAL CONNECTOR

CROSS REFERENCE TO RELATED APPLICATION

The contents of the following Japanese patent application are incorporated herein by reference, Japanese Patent Application No. 2016-146146 filed on Jul. 26, 2016.

FIELD

The present invention relates to an electrical connector having a waterproof function.

BACKGROUND

Conventionally known as an electrical connector having a waterproof function is one that includes a sealing member provided on the outer surface of a housing that covers a metal shell into which a mating connector is inserted. Such a sealing member may be in pressure contact with the enclosure of a device when the electrical connector is attached to the enclosure, thereby preventing the entry of a liquid, for example, into a circuit board inside the device through an attachment portion of the electrical connector to the enclosure of the device. However, since such an electrical connector needs to be provided with a housing on which the sealing member is provided, the electrical connector cannot be reduced in height and size.

In contrast to this, disclosed in Patent Literature 1 is an electrical connector in which the housing and the metal shell are integrally formed while the outer periphery of the metal shell toward an insertion opening into which a mating connector is to be inserted is exposed, and a sealing member is provided on the exposed portion of the metal shell from the housing. The electrical connector disclosed in Patent Literature 1 is provided with the sealing member directly on the metal shell, and thus can be reduced in height and size as compared with a conventional electrical connector that is provided with a sealing member on a housing.

CITATION LIST

Patent Literature

Patent Literature 1: Japanese Patent Application Laid-Open No. 2014-207140

SUMMARY

Technical Problem

However, in Patent Literature 1, the sealing member cannot be in pressure contact with a surface opposed to the insertion opening of the enclosure of the device with a bonding pressure required for waterproofness. Thus, depending on the shape of the enclosure to which the electrical connector is attached, it is not possible to prevent the entry of a liquid into the device through the attachment portion to the enclosure. Thus, the conventional electrical connector cannot be reduced in height and size while providing positive waterproof effects at the same time.

An object of the present invention is to provide an electrical connector which enables reduction in height and size, and positive waterproof effects at the same time when the attachment portion to the enclosure is made waterproof.

Solution to Problem

An electrical connector according to an aspect of the present invention includes: an electrically conductive contact; an insulating housing configured to hold the contact; a metal shell having an opening opened frontward to allow a mating connector to be inserted therein, the metal shell being configured to accommodate the housing; and a sealing member which is provided on an outer peripheral surface of the metal shell, the sealing member including a projected portion protruded frontward from the metal shell, wherein the metal shell has an inclined surface that is inclined so as to increase the opening in diameter frontward at a front end, and the projected portion is provided toward the outer peripheral surface with respect to the inclined surface.

When the electrical connector is attached to the enclosure, the projected portion of the sealing member protruded frontward from the metal shell is in pressure contact with the enclosure. It is thus possible to positively prevent the entry of a liquid into the enclosure through between the enclosure and the electrical connector even when the sealing member is provided on the metal shell.

According to the aspect of the present invention, when the attachment portion to the enclosure is made waterproof, this makes it possible to implement reduction in height, reduction in size, and positive waterproof effects at the same time.

DESCRIPTION OF EMBODIMENTS

Figure 1:
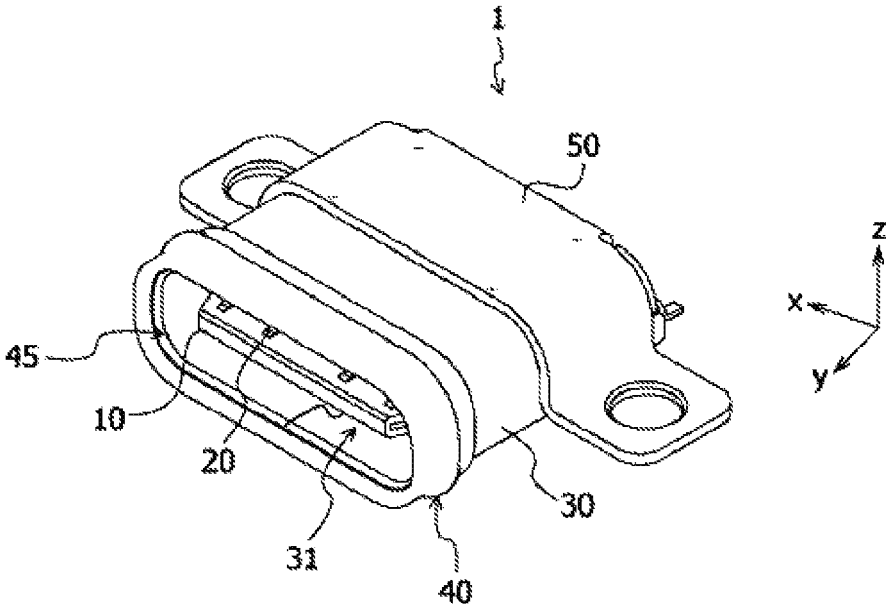
FIG. 1 is a perspective view illustrating an electrical connector according to a first embodiment of the present invention.
Figure 2:
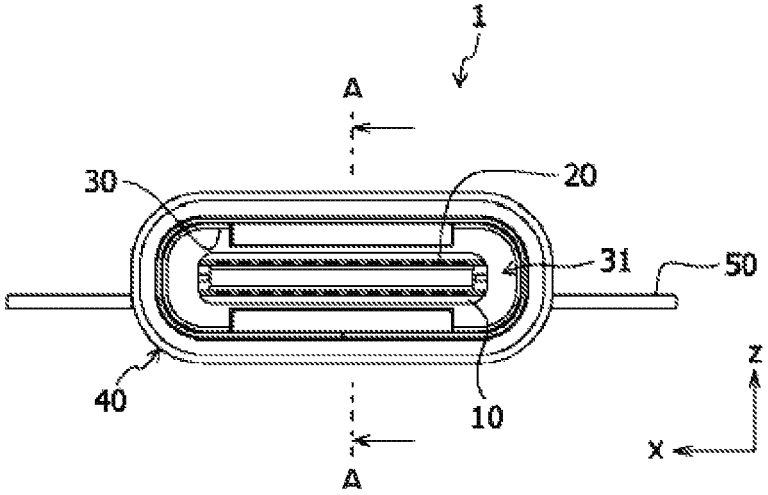
FIG. 2 is a front view illustrating the electrical connector according to the first embodiment of the present invention.
Figure 3:
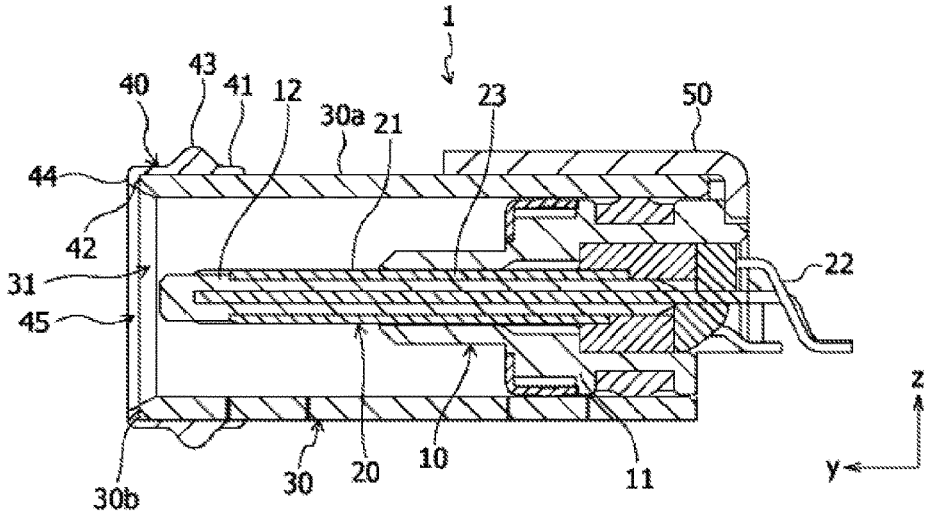
FIG. 3 is a cross-sectional view taken along line A-A of FIG. 2.
Figure 4:
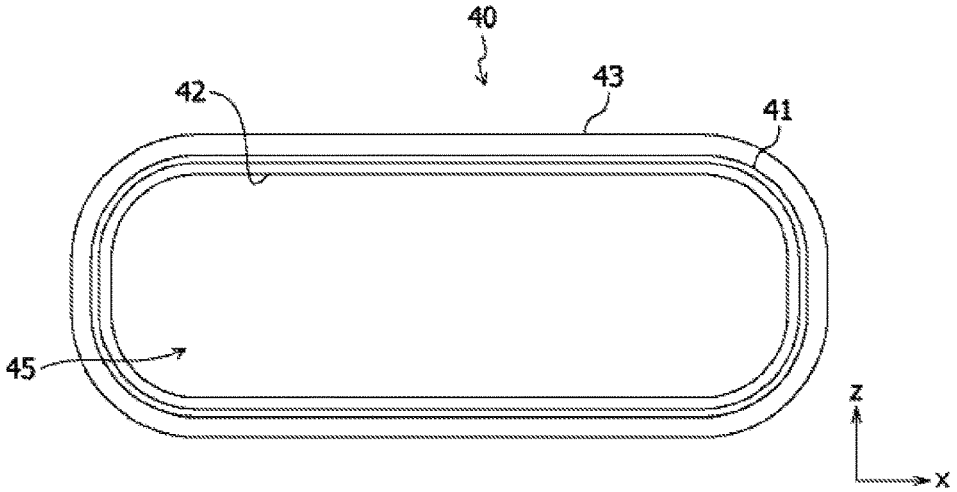
FIG. 4 is a rear view illustrating a sealing member according to the first embodiment of the present invention.
Figure 5:
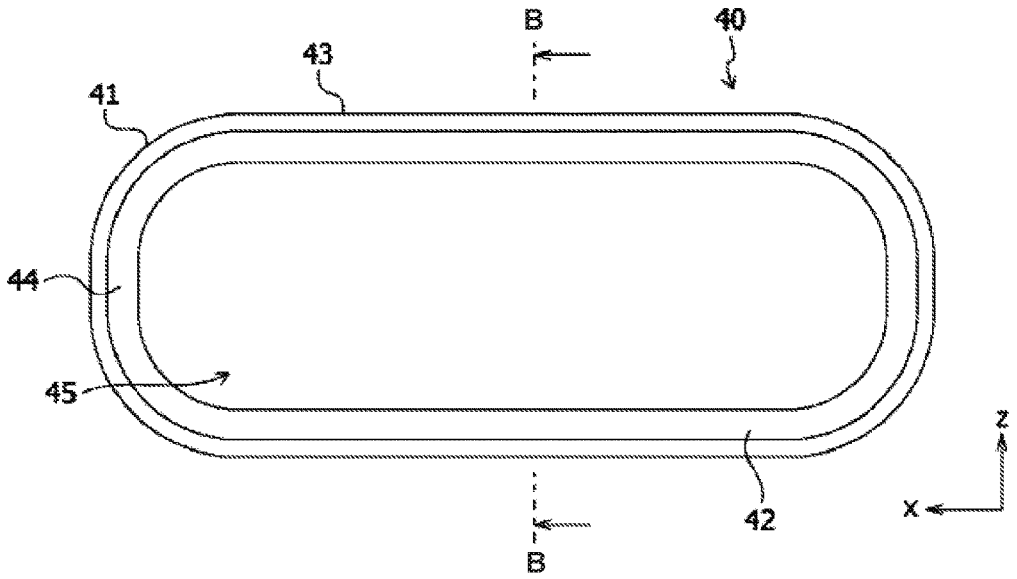
FIG. 5 is a front view illustrating the sealing member according to the first embodiment of the present invention.
Figure 6:
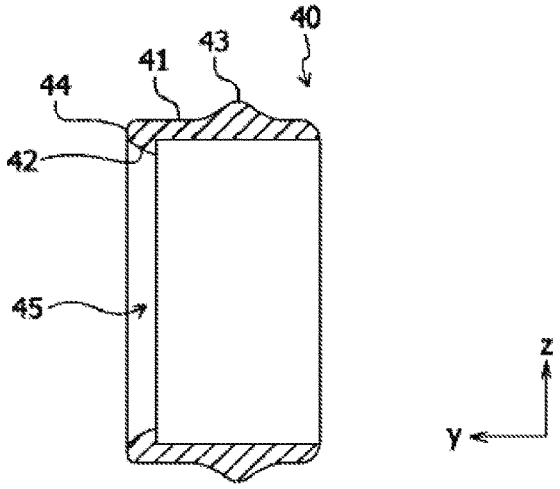
FIG. 6 is a cross-sectional view taken along line B-B of FIG. 5.

Now, with reference to the drawings as appropriate, an electrical connector according to an embodiment of the present invention will be described in more detail. In the drawings, a description will be given assuming that the x-axis, the y-axis, and the z-axis constitute the three-axis rectangular coordinate system; the positive direction of the y-axis is referred to as the front direction, the negative direction of the y-axis as the rear direction, the x-axis direction as the right-and-left direction, the positive direction of the z-axis as the upward direction, and the negative direction of the z-axis as the downward direction.

First Embodiment

<Configuration of Electrical Connector>

With reference to FIG. 1 to FIG. 7, the configuration of the electrical connector 1 according to a first embodiment of the present invention will be described in detail below.

The electrical connector 1 has a housing 10, contacts 20, a metal shell 30, a sealing member 40, and a subframe 50.

The housing 10 is formed of an insulating material and holds the contacts 20. The housing 10 includes a main body 11 and a projected part 12.

The main body 11 is press fitted into and thereby secured to the metal shell 30. Note that the means for securing the main body 11 to the metal shell 30 is not limited to the press fitting, but the integral molding or the engagement may also be employed.

The projected part 12 is protruded frontward from the front end of the main body 11 and mates with a mating connector (not shown).

The contacts 20 are formed of an electrically conductive material, and provided with a connection 21, a terminal 22, and a secured portion 23.

The connection 21 is exposed to the surface of the projected part 12 and can be connected to a contact of a mating connector.

The terminal 22 is protruded rearward from the rear end of the main body 11 and soldered and thereby connected to an electrically conductive portion of a circuit board (not shown).

The secured portion 23 is secured to the main body 11 by integral molding. The means for securing the secured portion 23 to the main body 11 is not limited to the integral molding, but the press fitting or the engagement may also be employed.

The metal shell 30 includes an opening 31 which is opened frontward to allow a mating connector to be inserted therein and stores the housing 10 holding the contacts 20. The metal shell 30 includes an outer peripheral surface 30*a* and a front surface 30*b* that is a cur surface.

The sealing member 40 is formed of an elastic material and provided on the metal shell 30, and includes a mounting part 41, a projected part 42, a pressure contact part 43, a pressure contact part 44, and an opening 45.

The mounting part 41 is attached to the outer peripheral surface 30*a* of the metal shell 30 toward the front thereof. The mounting part 41 is provided with the pressure contact part 43 which is protruded outward and which is brought into pressure contact with the enclosure of the device as a pressure contact object in the up-and-down and right-and-left directions.

The projected part 42 is protruded frontward from the metal shell 30 and covers the whole or part of the front surface 30*b* of the metal shell 30.

The projected part 42 is provided with the pressure contact part 44 which is brought into pressure contact with the enclosure of the device as a front pressure contact object.

The opening 45 penetrates in the back-and-forth direction to enable a mating connector to pass therethrough. The opening 45 communicates with the opening 31.

The subframe 50 is provided on the rear side of the outer peripheral surface 30*a* of the metal shell 30 and attached to the enclosure of the device. Note that the electrical connector 1 may not have to include the subframe 50.

<Method for Manufacturing Electrical Connector>

Figure 7:
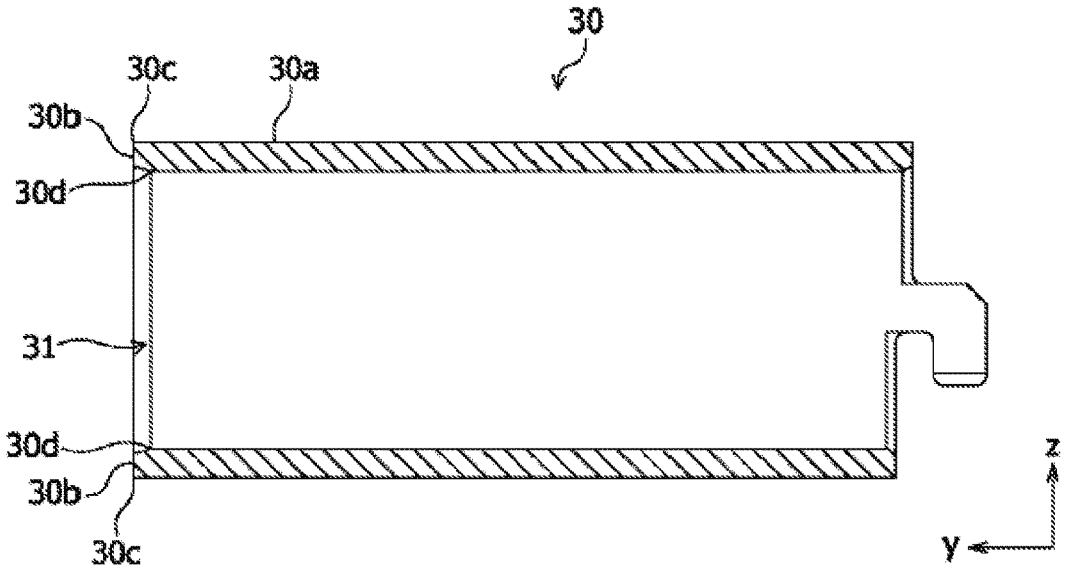
FIG. 7 is a cross-sectional view illustrating a metal shell according to the first embodiment of the present invention.

With reference to FIGS. 7 and 8, a method for manufacturing the electrical connector 1 according to the first embodiment of the present invention will be described in detail below.

Figure 8A:
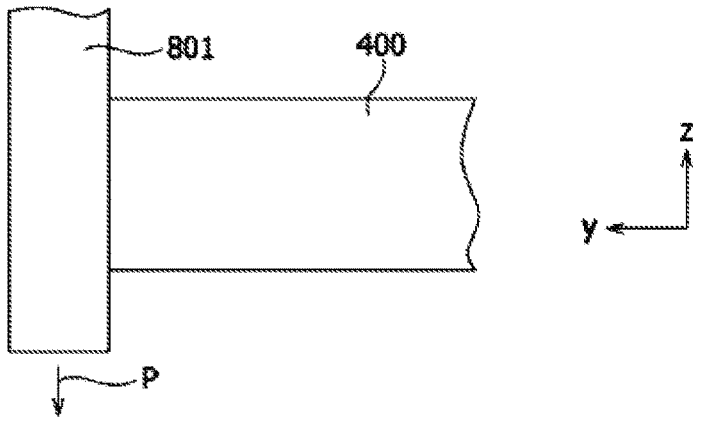
FIG. 8A is a view illustrating a method for manufacturing the metal shell according to the first embodiment of the present invention.
Figure 8B:
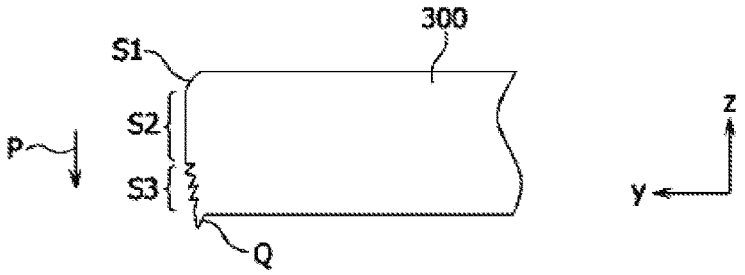
FIG. 8B is a view illustrating a method for manufacturing the metal shell according to the first embodiment of the present invention.
Figure 8C:
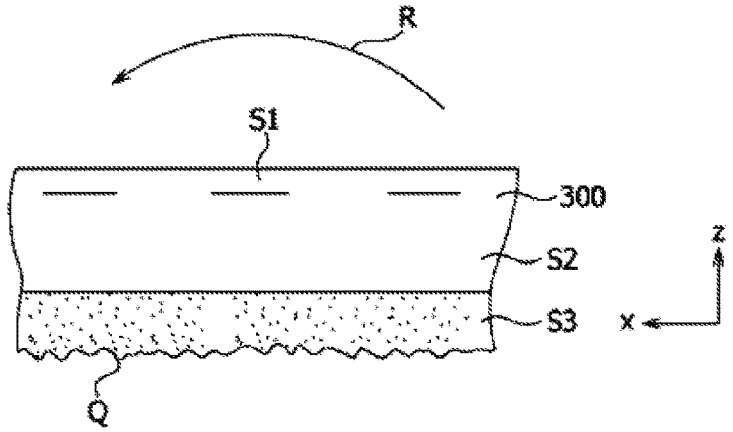
FIG. 8C is a view illustrating a method for manufacturing the metal shell according to the first embodiment of the present invention.
Figure 8D:
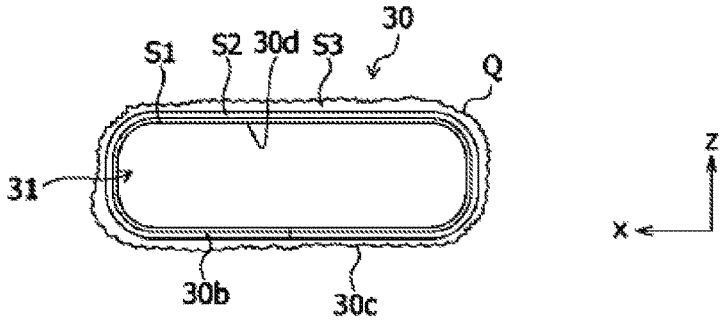
FIG. 8D is a view illustrating a method for manufacturing the metal shell according to the first embodiment of the present invention.

In FIG. 8A to FIG. 8D, FIG. 8A illustrates a metal plate being cut, FIG. 8B illustrates the metal plate having been cut, FIG. 8C illustrates the cut metal plate being bent, and FIG. 8D illustrates the metal shell 30 having been completed. Furthermore, in FIG. 8A to FIG. 8C, the vertical direction of a metal plate 400 and an intermediate member 300 is the plate thickness direction. Note that in FIG. 8A to FIG. 8D, for convenience of explanation, a rupture surface S3 and burrs Q are exaggerated.

First, the contacts 20 having been prepared in advance are secured to the housing 10 by integral molding. This allows the secured portion 23 of the contacts 20 to be secured to the main body 11 of the housing 10, so that the connection 21 of the contacts 20 is exposed to the surface of the projected part 12 of the housing 10 and the terminal 22 of the contacts 20 is protruded to outside from the main body 11.

On the other hand, the metal plate 400 is pressed to form the metal shell 30. More specifically, first, as shown in FIG. 8A, a cutter 801 is moved in the direction of arrow P relative to the metal plate so as to cut the metal plate and thereby form the intermediate member 300 in a size required to form the metal shell 30. At this time, as shown in FIG. 8B, on the cut surface of the intermediate member 300 are formed a sagging surface S1, a shear surface S2, and a rupture surface S3 in the direction of arrow P, and also formed are burrs Q that are protruded from the rupture surface S3 in the direction of arrow P.

Then, as shown in FIG. 8C, the intermediate member 300 is bent in the direction of arrow R so as to form the metal shell 30. As shown in FIG. 8D, the metal shell 30 formed as mentioned above has the rupture surface S3 toward an outer edge 30*c* of the front surface 30*b* and has the burrs Q protruded outward from the rupture surface S3. Furthermore, the metal shell 30 has the sagging surface S1 on an inner edge 30*d* of the front surface 30*b* and has the shear surface S2 between the sagging surface S1 and the rupture surface S3.

Next, the sealing member 40 having been prepared in advance is attached to the metal shell 30. The sealing member 40 is attached to the metal shell 30 by press fitting or LIM (Liquid Injection Molding). Here, in the LIM method, the intermediate member 300 is placed in the metal molds, and then a liquid-state elastomer raw material is flown therein under a predetermined pressure and heated to be thereby hardened.

The rupture surface S3 is provided on the front surface 30*b*, or the cut surface of the metal shell 30, toward the outer edge 30*c*, and the outer edge 30*c* is covered with the sealing member 40, thereby allowing the sealing member 40 to be robustly attached to the metal shell 30. In particular, when the burrs Q are protruded from the rupture surface S3, the burrs Q can be engaged in the sealing member 40, thereby allowing the sealing member 40 to be more robustly attached to the metal shell 30.

Next, the housing 10 integrated with the contacts 20 is secured to the metal shell 30 that is provided with the sealing member 40.

Next, the subframe 50 is attached to the metal shell 30, thereby completing the electrical connector 1.

<Method for Using Electrical Connector>

Figure 9:
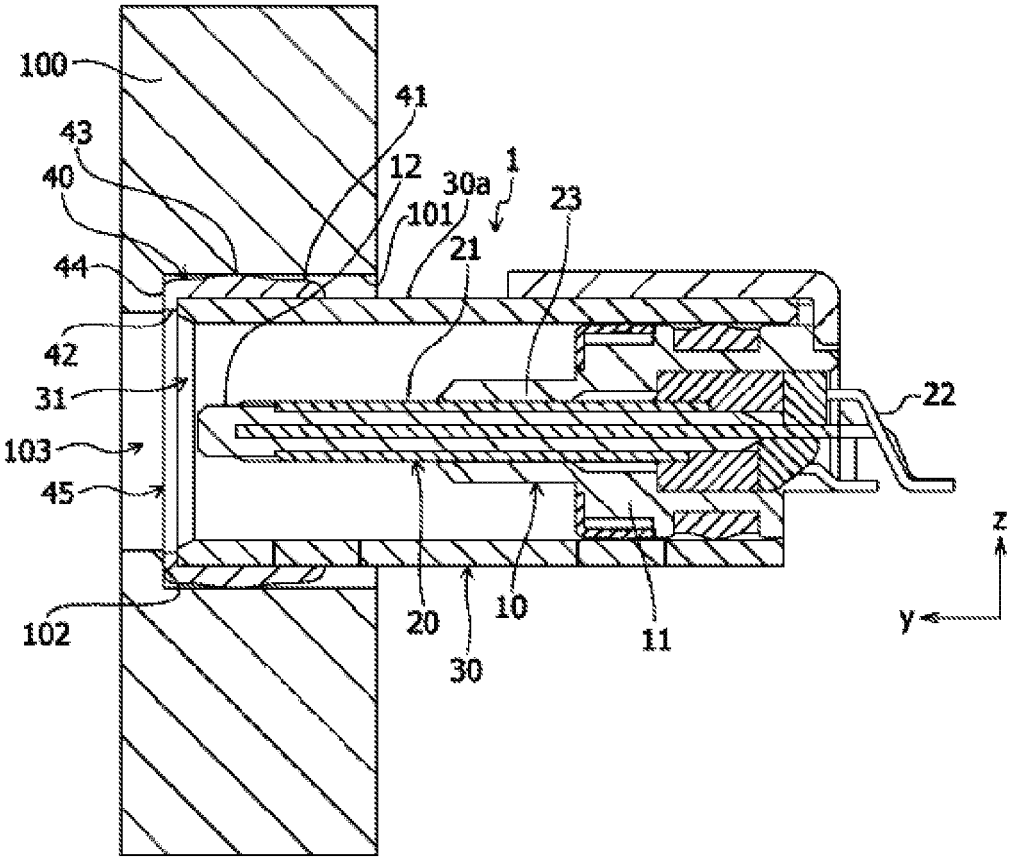
FIG. 9 is a view illustrating the electrical connector being used according to the first embodiment of the present invention.

With reference to FIG. 9, a method for using the electrical connector 1 according to the first embodiment of the present invention will be described in detail below.

In the course of attaching the electrical connector 1 to a predetermined attachment portion of the enclosure 100, the pressure contact part 43 of the mounting part 41 of the sealing member 40 is in pressure contact with an inner wall 101 of the enclosure 100 in the up-and-down and right-and-left directions. At this time, the mounting part 41 is pulled rearward by the friction with the inner wall 101 as the electrical connector 1 is moved frontward, so that an external force is applied to the mounting part 41 so as to be stripped off from the outer peripheral surface 30*a*.

However, the projected part 42 is in pressure contact with the front surface 30*b* so as to act as a stopper when the sealing member 40 is moved rearward, thus preventing the sealing member 40 from being dislodged from the metal shell 30. Furthermore, the outer edge 30*c* being covered with the sealing member 40 positively prevents the sealing member 40 from being dislodged from the metal shell 30 by the frictional force between the sealing member 40 and the rupture surface S3 or the burrs Q being engaged in the sealing member 40.

Furthermore, the pressure contact part 44 of the projected part 42 of the sealing member 40 is in pressure contact with a front inner wall 102 of the enclosure 100.

The electrical connector 1 is completely attached to an attachment portion of the enclosure 100 by the subframe 50 being secured to the enclosure 100. This allows the pressure contact part 43 to be kept in a state of being in pressure contact with the inner wall 101 and the pressure contact part 44 to be kept in a state of being in pressure contact with the inner wall 102.

When a liquid is entering through an opening 103 of the enclosure 100, the pressure contact part 44 of the projected part 42 and the pressure contact part 43 of the mounting part 41 can prevent the entry of the liquid into the enclosure 100, thereby implementing waterproofness.

As described above, according to this embodiment, the sealing member 40 is provided on the outer peripheral surface 30*a* of the metal shell 30 for accommodating the housing 10 and is protruded frontward from the metal shell 30. When the attachment portion to the enclosure is made waterproof, this makes it possible to implement reduction in height, reduction in size, and positive waterproof effects at the same time.

Furthermore, according to this embodiment, when the sealing member 40 is provided on the metal shell 30 with which the sealing member 40 can be brought into intimate contact with difficulty, the projected part 42 can prevent the sealing member 40 from being dislodged from the metal shell 30.

Furthermore, according to this embodiment, since the sealing member 40 can be brought into pressure contact with both the up-and-down, right-and-left enclosure and the frontward enclosure, it is possible to provide improved ease of use as an electrical connector having a waterproof function. By eliminating the need of providing sealing members formed in different shapes depending on the device to which the electrical connector 1 is attached, it is possible to cut costs and thus reduce manufacturing costs.

Furthermore, according to this embodiment, the metal shell 30 is provided with the sealing member 40, thereby allowing the electrical connector 1 to be reduced in size or height.

Second Embodiment

<Configuration of Electrical Connector>

Figure 10:
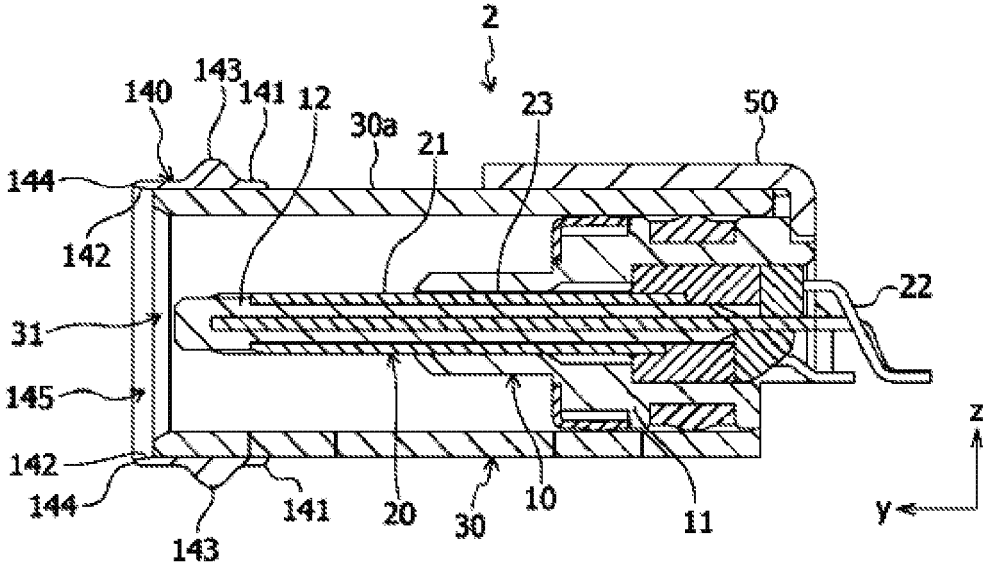
FIG. 10 is a cross-sectional view illustrating an electrical connector according to a second embodiment of the present invention.

With reference to FIG. 10, the configuration of an electrical connector 2 according to a second embodiment of the present invention will be described in detail below.

Note that in FIG. 10, the components having the same configuration as those of FIG. 1 to FIG. 7 will be given the same symbols and will not be repeatedly described.

The electrical connector 2 has the housing 10, the contacts 20, the metal shell 30, the subframe 50, and a sealing member 140.

The sealing member 140 is formed of an elastic material and provided on the metal shell 30, and includes a mounting part 141, a projected part 142, a pressure contact part 143, a pressure contact part 144, and an opening 145.

The mounting part 141 is attached to the outer peripheral surface 30*a* of the metal shell 30 toward the front thereof. The mounting part 141 is provided with the pressure contact part 143 which is brought into pressure contact with the enclosure of the device as a pressure contact object in the up-and-down and right-and-left directions. The pressure contact part 143 is protruded outwardly.

The projected part 142 is protruded frontward from the metal shell 30. The projected part 142 is provided with the pressure contact part 144 which is brought into pressure contact with the enclosure of the device as a front pressure contact object.

The opening 145 penetrates in the back-and-forth direction to enable a mating connector to pass therethrough. The opening 145 communicates with the opening 31.

Note that a method for manufacturing the electrical connector 2 is the same as the method for manufacturing the electrical connector 1 and thus will not be repeatedly explained.

<Method for Using Electrical Connector>

The method for using the electrical connector 2 according to the second embodiment of the present invention will be described in detail below.

In the course of attaching the electrical connector 2 to a predetermined attachment portion of the enclosure 100, the pressure contact part 143 of the mounting part 141 of the sealing member 140 is in pressure contact with the inner wall 101 of the enclosure 100 in the up-and-down and right-and-left directions.

Furthermore, the pressure contact part 144 of the projected part 142 of the sealing member 140 is in pressure contact with the front inner wall 102 of the enclosure 100.

The electrical connector 2 is completely attached to an attachment portion of the enclosure 100 by the subframe 50 being secured to the enclosure 100. This allows the pressure contact part 143 to be kept in a state of being in pressure contact with the inner wall 101 and the pressure contact part 144 to be kept in a state of being in pressure contact with the inner wall 102.

When a liquid is entering through the opening 103 of the enclosure 100, the pressure contact part 144 of the projected part 142 and the pressure contact part 143 of the mounting part 141 can prevent the entry of the liquid into the enclosure 100, thereby implementing waterproofness.

As described above, according to this embodiment, the sealing member 140 is provided on the outer peripheral surface 30*a* of the metal shell 30 for accommodating the housing 10 and is protruded frontward from the metal shell 30. When the attachment portion to the enclosure is made waterproof, this makes it possible to implement reduction in height, reduction in size, and positive waterproof effects at the same time.

Furthermore, according to this embodiment, since the sealing member 140 can be brought into pressure contact with both the up-and-down right-and-left enclosure and the frontward enclosure, it is possible to provide improved ease of use as an electrical connector having the waterproof function. By eliminating the need of providing sealing members formed in different shapes depending on the device to which the electrical connector 2 is attached, it is possible to cut costs and thus reduce manufacturing costs.

Furthermore, according to this embodiment, the metal shell 30 is provided with the sealing member 140, thereby allowing the electrical connector 2 to be reduced in size or height.

Note that in the present invention, the type, the placement, and the number of the members are not limited to the aforementioned embodiments, but as a matter of course, may also be changed, as appropriate, without departing from the scope and spirit of the invention, for example, by replacing the components with those that have the same operational effects, as appropriate.

More specifically, in the aforementioned first and second embodiments, the sealing member 40 is brought into pressure contact with both the up-and-down, right-and-left pressure contact object and the front pressure contact object. However, the sealing member may also be brought into pressure contact with either one of the up-and-down, right-and-left pressure contact object and the front pressure contact object.

Furthermore, in the aforementioned first and second embodiments, the pressure contact part 44 is given a flat shape in the vertical direction. However, the pressure contact part 44 may also be provided with a projected portion that is protruded frontward. In this case, the sealing member can be brought into pressure contact with the front pressure contact object with a greater force, thereby providing an improved waterproof function.

Furthermore, in the aforementioned first and second embodiments, for the configuration in which the metal shell 30 is provided with a sealing member, the shape and placement of the housing 10 and the contacts 20 can be arbitrarily determined, and the number of contacts 20 can also be arbitrarily determined.

The embodiments of the present invention are preferred to an electrical connector that is provided with a waterproof function.

REFERENCE SIGNS LIST

1 electrical connector
2 electrical connector
10 housing
11 main body
12 projected part
20 contact
21 connection
22 terminal
23 secured portion
30 metal shell
30*a* outer peripheral surface
30*b* front surface
30*c* outer edge
30*d* inner edge
31 opening
40 sealing member
41 mounting part
42 projected part
43 pressure contact part
44 pressure contact part
45 opening

The invention claimed is:

1. An electrical connector comprising:
an electrically conductive contact;
an insulating housing configured to hold the contact;
a metal shell having an opening opened frontward to allow a mating connector to be inserted therein, the metal shell being configured to accommodate the housing; and
a sealing member which is provided on an outer peripheral surface of the metal shell, the sealing member including a projected portion protruded frontward from the metal shell, wherein
the metal shell has an inclined surface that is inclined so as to increase the opening in diameter frontward at a front end, and
the projected portion is provided toward the outer peripheral surface with respect to the inclined surface, and covers a front surface of the metal shell such that the inclined surface of the metal shell is exposed.

2. The electrical connector according to claim 1, wherein an intersection between the front surface of the metal shell and the inclined surface of the metal shell is exposed.

3. The electrical connector according to claim 1, wherein the entire inclined surface of the metal shell is exposed.

4. The electrical connector according to claim 1, wherein the projected portion covers the entire front surface of the metal shell.

5. The electrical connector according to claim 1, wherein the projected portion covers a part of the front surface of the metal shell.

6. An electrical connector comprising:
an electrically conductive contact;
an insulating housing configured to hold the contact;
a metal shell having an opening opened frontward to allow a mating connector to be inserted therein, the metal shell being configured to accommodate the housing; and
a sealing member which is provided on an outer peripheral surface of the metal shell, the sealing member including a projected portion protruded frontward from the metal shell, wherein
the metal shell has an inclined surface that is inclined so as to increase the opening in diameter frontward at a front end, and
the projected portion is provided toward the outer peripheral surface with respect to the inclined surface, and covers the metal shell from a front surface thereof such that the inclined surface of the metal shell is exposed, wherein
the metal shell includes a rapture surface, which is a cut surface, on the front surface toward an outer edge, and
the sealing member covers the outer edge.

* * * * *